US006835168B2

(12) United States Patent
Huang

(10) Patent No.: US 6,835,168 B2
(45) Date of Patent: Dec. 28, 2004

(54) EXERCISE BALL DEVICE

(76) Inventor: Yang-Chin Huang, No. 2, Alley 492, Hai Tian Rd. Sec. 2, Tainan City (TW)

( * ) Notice: Subject to any disclaimer, the term of this patent is extended or adjusted under 35 U.S.C. 154(b) by 49 days.

(21) Appl. No.: 10/316,587

(22) Filed: Dec. 9, 2002

(65) Prior Publication Data

US 2004/0110609 A1 Jun. 10, 2004

(51) Int. Cl.[7] ..... A63B 21/02

(52) U.S. Cl. ..... 482/123; 482/77; 482/130; 482/139; 482/146; 482/148

(58) Field of Search ..... 482/123, 130, 482/148, 77, 79, 121, 139, 146; 472/129, 134, 135; 273/449

(56) References Cited

U.S. PATENT DOCUMENTS 3,167,312 A * 1/1965 Blanchard ..... 482/128
3,179,409 A * 4/1965 Angelo ..... 482/77
3,627,314 A * 12/1971 Brown ..... 482/77
3,716,229 A * 2/1973 Van Der Cleyen et al. ... 482/77
4,893,809 A * 1/1990 Blankenzee ..... 482/77
5,352,176 A * 10/1994 Huang ..... 482/146
5,569,131 A * 10/1996 Giulianelli ..... 482/77
5,795,277 A * 8/1998 Bruntmyer ..... 482/146
5,897,474 A * 4/1999 Romero ..... 482/146
6,017,297 A * 1/2000 Collins ..... 482/146
6,346,065 B1 * 2/2002 Lapointe ..... 482/77
2003/0224914 A1 * 12/2003 De Montesquieux ..... 482/148
2004/0038784 A1 * 2/2004 Huang ..... 482/121

* cited by examiner

*Primary Examiner*—Nichols D. Lucchesi
*Assistant Examiner*—Victor Hwang

(57) ABSTRACT

An exercise ball device has an elastic cable, two end hooks disposed on two ends of the elastic cable, a ball having a retainer ring to receive one of the end hooks, a treadle having a hole, and a soft cushion having a retainer ring to receive the other one of the end hooks, which penetrated a hole on a treadle.

2 Claims, 4 Drawing Sheets

EXERCISE BALL DEVICE

BACKGROUND OF THE INVENTION

The present invention relates to an exercise ball device. More particularly, the present invention relates to an exercise ball device, which can be connected with various articles.

A conventional ball is used for a ball game only. A user cannot use the ball to exercise many portions of a human body in a ball game.

SUMMARY OF THE INVENTION

An object of the present invention is to provide an exercise ball device, which can be connected with various articles.

Another object of the present invention is to provide an exercise ball device, which can be used for exercising many portions of a human body.

Accordingly, an exercise ball device comprises an elastic cable, two end hooks disposed on two ends of the elastic cable, a ball having a retainer ring to receive one of the end hooks, a treadle having a hole, and a soft cushion having a retainer ring to receive the other one of the end hooks, which penetrated a hole on a treadle.

DETAILED DESCRIPTION OF THE INVENTION

Figure 1:
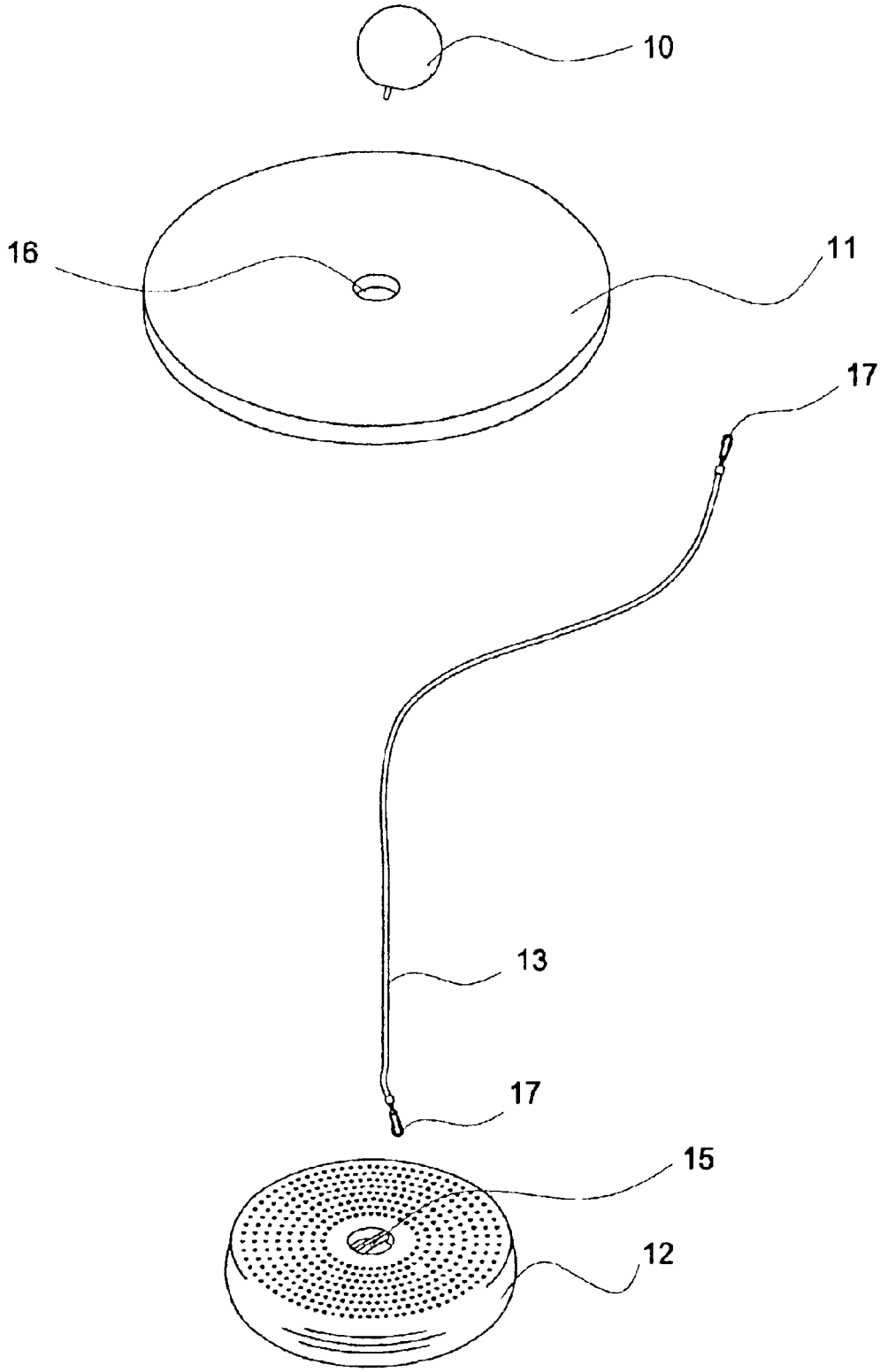
FIG. 1 is a perspective exploded view of exercise ball device of a first preferred embodiment in accordance with the present invention.
Figure 2:
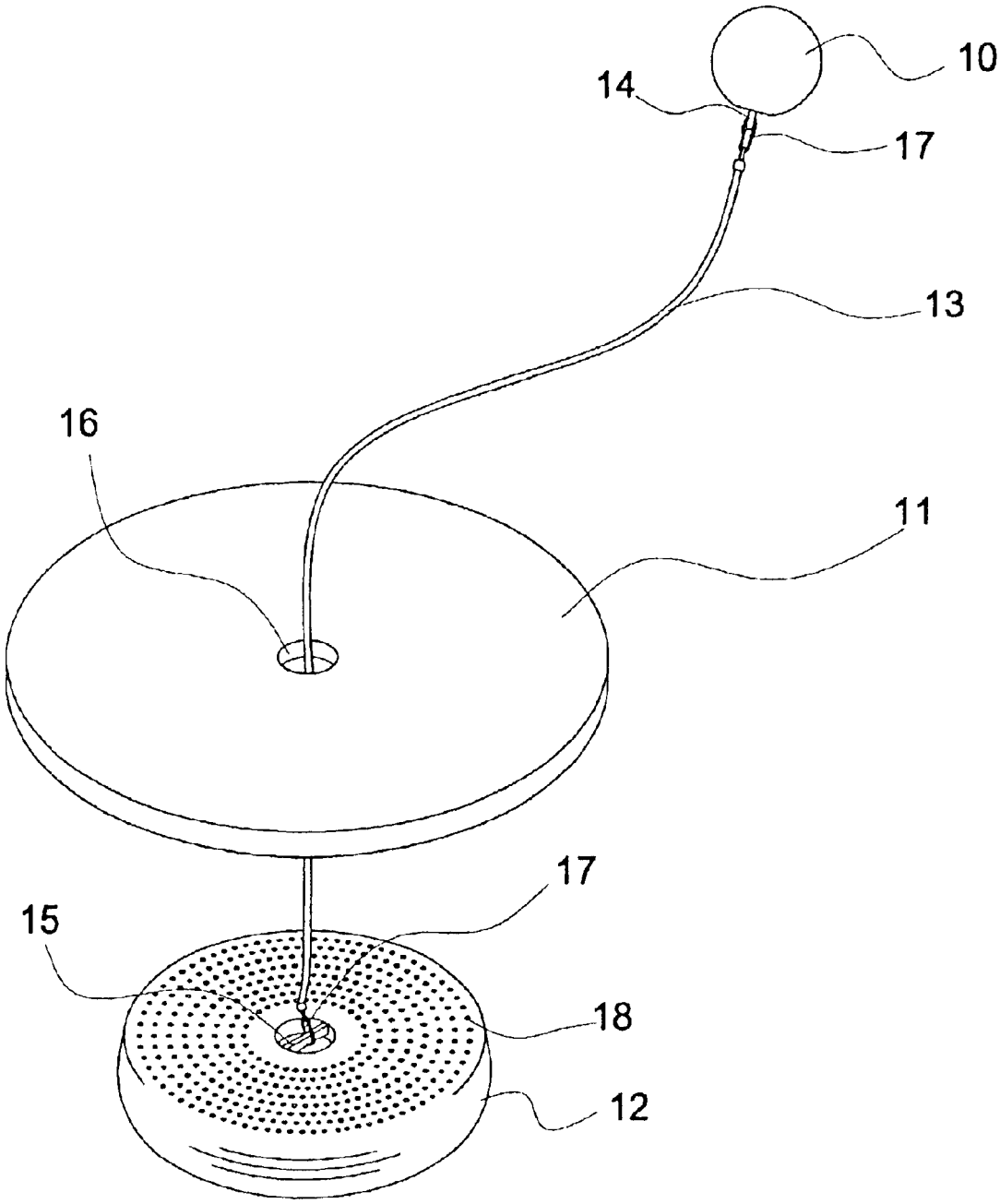
FIG. 2 is a perspective assembly view of an exercise ball device of a first preferred embodiment in accordance with the present invention.

Referring to FIGS. 1 to 2, an exercise ball device 1 comprises an elastic cable 13, two end hooks 17 disposed on two ends of the elastic cable 13, a ball 10 having a retainer ring 14 to receive one of the end hooks 17, a treadle having 11 a hole 16, and a soft cushion 12 having a retainer ring 15 to receive the other one of the end hooks 17, which penetrated a hole 16 on a treadle 11.

Figure 3:
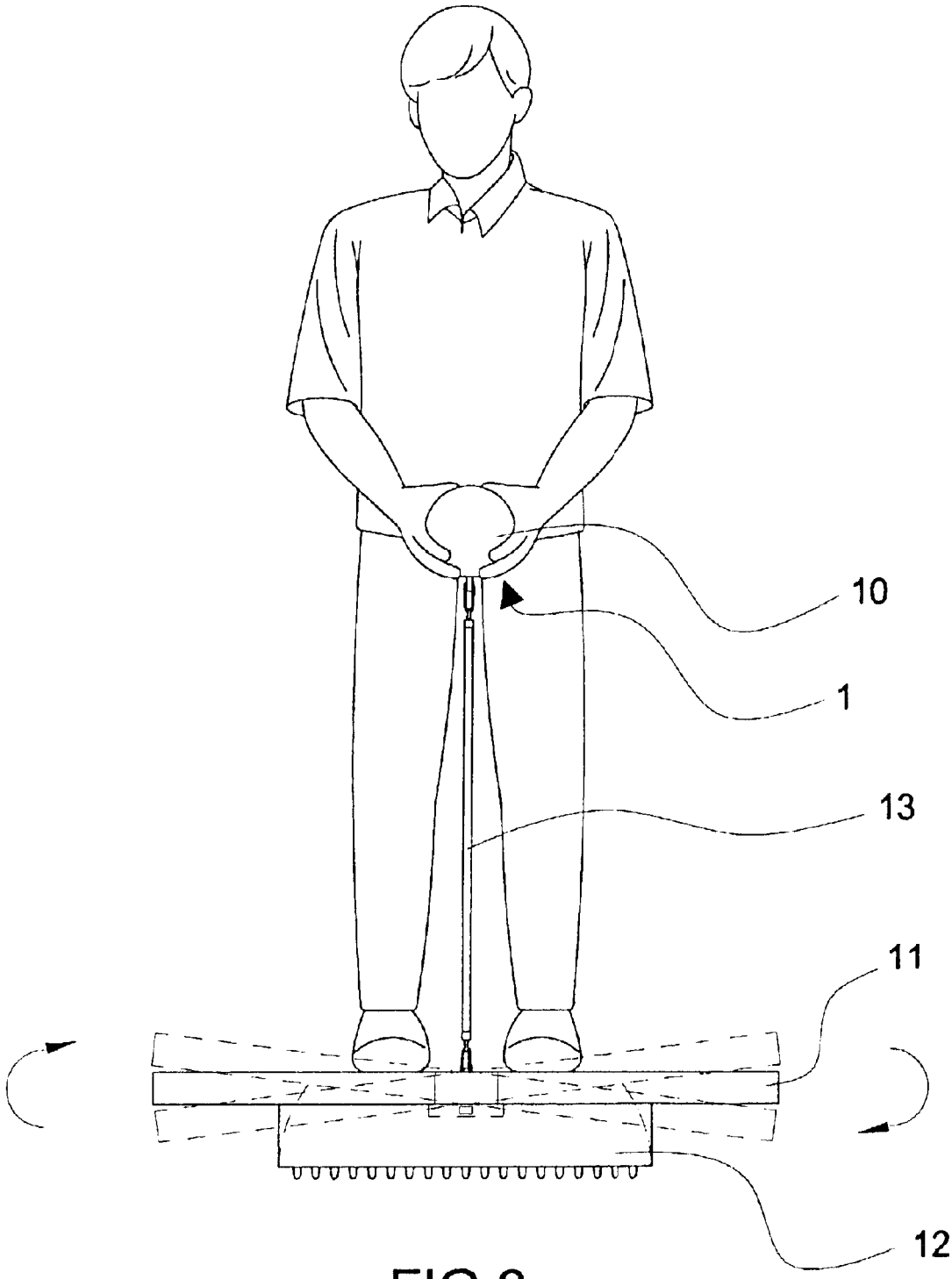
FIG. 3 is a schematic view illustrating a user holds a ball and an elastic cable is penetrated to a hold of a treadle and connected with a soft cushion.

Referring to FIG. 3, a user holds a ball 10 and an elastic cable 13 is penetrated to a hole 16 of a treadle 11 and connected with a soft cushion 12.

Figure 4:
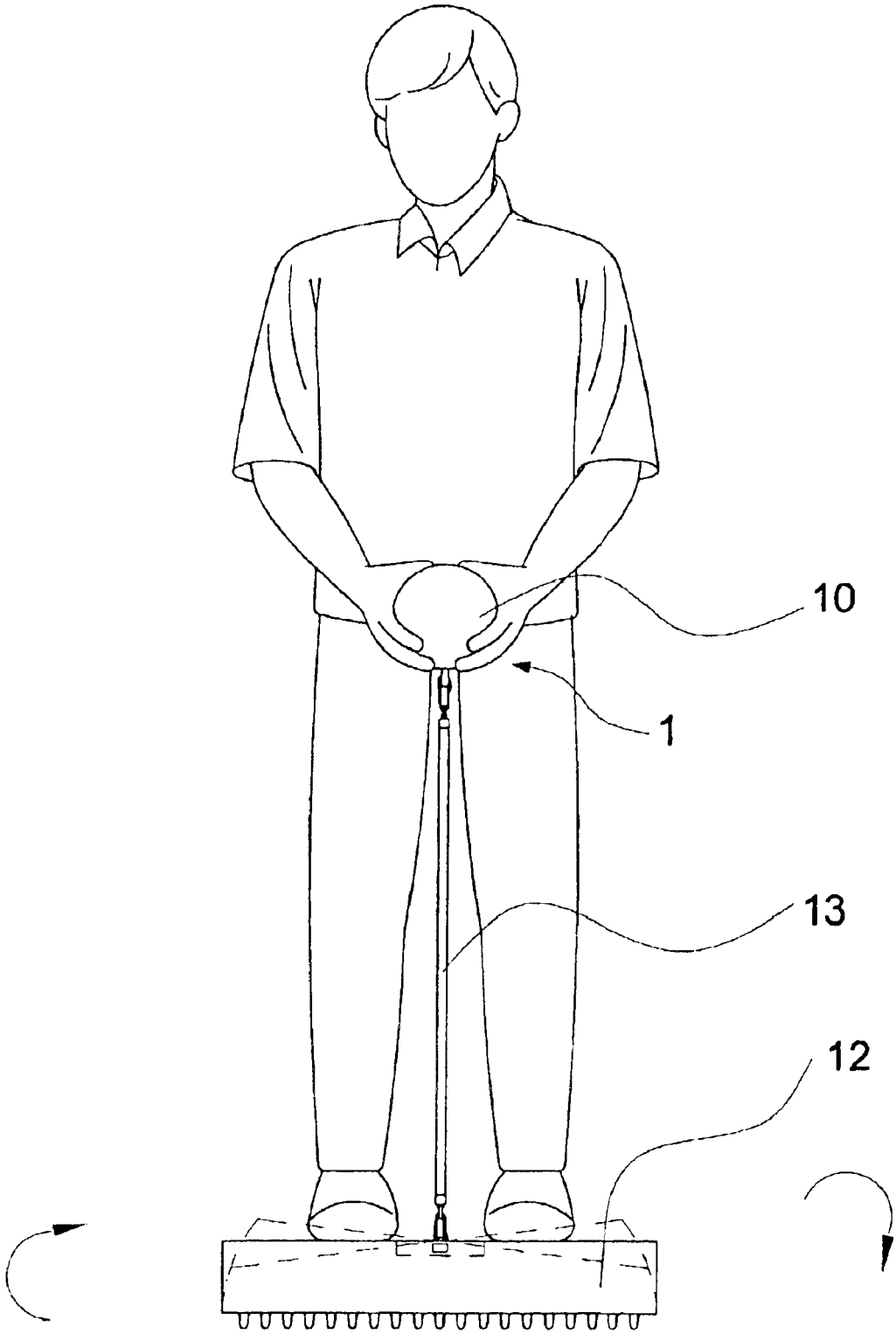
FIG. 4 is a schematic view illustrating a user holds a ball and an elastic cable is connected with a soft cushion having many protrudent granules.

Referring to FIG. 4, a user holds a ball 10 and an elastic cable 13 is connected with a soft cushion 12 having many protrudent granules 18.

The invention is not limited to the above embodiment but various modification thereof may be made. Further, various changes in form and detail may be made without departing from the scope of the invention.

What is claimed is:

1. An exercise ball comprising:

an elastic cable having two ends;

two end hooks, one end hook disposed on each respective end of the elastic cable;

a ball having a retainer ring to receive one of the end hooks;

a treadle having a hole; and a soft cushion having a retainer ring to receive the other one of the end hooks which penetrated the hole in the treadle.

2. The exercise ball device according to claim 1, wherein the soft cushion has many protrudent granules on a surface of the soft cushion.

* * * * *